US011002025B2

(12) United States Patent
Sighinolfi

(10) Patent No.: US 11,002,025 B2
(45) Date of Patent: May 11, 2021

(54) LEVELING SPACER DEVICE

(71) Applicant: RAIMONDI S.P.A., Modena (IT)

(72) Inventor: Riccardo Sighinolfi, Rubiera (IT)

(73) Assignee: RAIMONDI S.P.A., Modena (IT)

( * ) Notice: Subject to any disclaimer, the term of this patent is extended or adjusted under 35 U.S.C. 154(b) by 0 days.

(21) Appl. No.: 16/405,342

(22) Filed: May 7, 2019

(65) Prior Publication Data

US 2019/0345724 A1 Nov. 14, 2019

(30) Foreign Application Priority Data

May 9, 2018 (IT) ..... 102018000005212

(51) Int. Cl.
*E04F 21/22* (2006.01)
*E04F 21/00* (2006.01)
*E04F 21/18* (2006.01)

(52) U.S. Cl.
CPC ..... *E04F 21/22* (2013.01); *E04F 21/0092* (2013.01); *E04F 21/1877* (2013.01)

(58) Field of Classification Search
CPC ... E04F 21/0092; E04F 21/22; E04F 21/1844; E04F 13/0892; E04F 15/02005; E04F 21/1877
See application file for complete search history.

(56) References Cited

U.S. PATENT DOCUMENTS 3,552,257 A 1/1971 Tanabe
3,961,453 A 6/1976 Couwenbergs
4,024,683 A 5/1977 Kilian
4,397,125 A 8/1983 Gussler, Jr.
7,257,926 B1 8/2007 Kirby
(Continued)

FOREIGN PATENT DOCUMENTS

AR 101851 A1 1/2017
AU 2012211345 A1 2/2014
(Continued)

OTHER PUBLICATIONS

Primo Tools Vortex Leveling System—TLSS120—The Home Depot (Dec. 20, 2018).

(Continued)

*Primary Examiner* — Babajide A Demuren
(74) *Attorney, Agent, or Firm* — Browdy and Neimark, PLLC

(57) ABSTRACT

A leveling spacer device for laying sheet shaped products for the covering of surfaces, including a base, which may be positioned at the rear of a laying surface of at least two sheet shaped products being adjacent and placed side-by-side relative to a side-by-side direction, a separator element rising from, and perpendicular to, the base and configured to slide between the facing side walls of the two sheet shaped products placed side by side, a threaded stem rising from the separator element with a screw axis orthogonal to the base, a presser screwable onto the threaded stem and an anti-sliding protection ring interposable between the presser and the base. The protection ring includes a first surface facing towards and configured to contact the presser and a second opposing surface facing towards the base. The second surface has a sliding friction coefficient greater than a sliding friction coefficient of the first surface.

15 Claims, 7 Drawing Sheets

(56) References Cited

U.S. PATENT DOCUMENTS

| | | | | |
|---|---|---|---|---|
| 7,621,100 | B2 | 11/2009 | Kufner et al. | |
| 7,861,487 | B2 | 1/2011 | Kufner et al. | |
| 7,954,300 | B1 | 6/2011 | Kufner et al. | |
| 7,992,354 | B2 | 8/2011 | Doda, Jr. | |
| 8,079,199 | B1 | 12/2011 | Kufner et al. | |
| 8,181,420 | B2 | 5/2012 | Torrents I Comas | |
| 8,336,279 | B2 | 12/2012 | Kufner et al. | |
| 8,429,879 | B1 | 4/2013 | Hoffman | |
| 8,635,815 | B2 | 1/2014 | Bordin | |
| 8,950,079 | B2 | 2/2015 | Hillebrandt | |
| 9,228,363 | B2 | 1/2016 | Kufner et al. | |
| 9,279,259 | B1 | 3/2016 | Russo | |
| 9,322,185 | B1 | 4/2016 | Russo | |
| 9,322,186 | B1 | 4/2016 | Chang et al. | |
| 9,328,522 | B2 | 5/2016 | Bordin | |
| 9,470,002 | B2 | 10/2016 | Irvine et al. | |
| 9,470,003 | B1 | 10/2016 | Moon | |
| 9,482,018 | B2 | 11/2016 | Torrents I Comas | |
| 9,482,019 | B2 | 11/2016 | Fontana | |
| 9,964,849 | B2 | 5/2018 | Murakami et al. | |
| 2006/0185269 | A1 | 8/2006 | Kufner et al. | |
| 2010/0263304 | A1 | 10/2010 | Torrents I Comas | |
| 2010/0287868 | A1 | 11/2010 | Kufner et al. | |
| 2013/0067854 | A1 | 3/2013 | Bordin | |
| 2013/0104497 | A1 | 5/2013 | Ross | |
| 2014/0033641 | A1 | 2/2014 | Trevisi | |
| 2014/0298736 | A1 | 10/2014 | Bunch et al. | |
| 2014/0325936 | A1* | 11/2014 | PSaila | E04F 21/1877 52/749.11 |
| 2015/0211243 | A1 | 7/2015 | Irvine et al. | |
| 2015/0308130 | A1 | 10/2015 | Biec | |
| 2015/0354231 | A1 | 12/2015 | Bordin | |
| 2016/0036518 | A1 | 2/2016 | Roos et al. | |
| 2016/0090746 | A1 | 3/2016 | Sighinolfi | |
| 2016/0298342 | A1 | 10/2016 | Moon | |
| 2016/0369518 | A1* | 12/2016 | Sarajian | E04F 21/22 |
| 2017/0044779 | A1 | 2/2017 | Teng | |
| 2018/0148939 | A1 | 5/2018 | Sighinolfi | |
| 2019/0093372 | A1 | 3/2019 | Russo | |

FOREIGN PATENT DOCUMENTS

| | | | |
|---|---|---|---|
| AU | 2014100939 | A4 | 9/2014 |
| AU | 2015100045 | A4 | 2/2015 |
| BR | 102014021953 | A2 | 4/2015 |
| CA | 2784633 | A1 | 2/2014 |
| CN | 201614727 | U | 10/2010 |
| CN | 103362295 | A | 10/2013 |
| CN | 204174898 | U | 2/2015 |
| CN | 2014139562 | U | 2/2015 |
| CN | 204299130 | U | 4/2015 |
| CN | 204456799 | U | 7/2015 |
| CN | 204609253 | U | 9/2015 |
| CN | 204609254 | U | 9/2015 |
| CN | 204940818 | U | 1/2016 |
| CN | 205134907 | U | 4/2016 |
| DE | 19926717 | A1 | 3/2000 |
| DE | 202015102847 | U1 | 7/2015 |
| EP | 2330261 | A1 | 6/2011 |
| EP | 2514886 | A1 | 10/2012 |
| EP | 2549030 | A2 | 1/2013 |
| EP | 2762658 | A1 | 8/2014 |
| EP | 2907937 | A1 | 8/2015 |
| EP | 2952652 | A1 | 12/2015 |
| EP | 2966238 | A1 | 1/2016 |
| EP | 2966239 | A1 | 1/2016 |
| EP | 3147423 | A1 | 3/2017 |
| EP | 3421686 | A1 | 1/2019 |
| ES | 1138645 | U | 4/2015 |
| GB | 2540826 | A | 2/2017 |
| JP | 2544545 | A | 1/1994 |
| JP | 07305494 | A | 10/1995 |
| JP | 2013204318 | A | 10/2013 |
| JP | 2014201997 | A | 10/2014 |
| JP | 2016065362 | A | 4/2016 |
| NL | 1041077 | B1 | 10/2016 |
| RU | 146122 | U1 | 9/2014 |
| RU | 159255 | U1 | 2/2016 |
| RU | 159258 | U1 | 2/2016 |
| RU | 2585128 | C1 | 5/2016 |
| TW | 439678 | U | 6/2001 |
| TW | 456396 | U | 9/2001 |
| TW | 473422 | U | 3/2014 |
| WO | 2013023236 | A1 | 2/2013 |
| WO | 2014022889 | A1 | 2/2014 |
| WO | 2014177736 | A1 | 11/2014 |
| WO | 2016165010 | A1 | 10/2016 |
| WO | 2016189423 | A1 | 12/2016 |

OTHER PUBLICATIONS

Pro levelling System and Levelling Puck (Jan. 13, 2014).
Simple Accurate Levelling System Brochure, ARDEX Australia Pty Ltd.
Wurth, Sitema Para Nivelar Cerámica 2 Puntos De Rotura.

* cited by examiner

LEVELING SPACER DEVICE

TECHNICAL FIELD

The present invention relates to a leveling spacer device for laying sheet shaped products, such as tiles, slabs of natural stone or the like, for the covering of surfaces, such as surfaces that can be walked on, floors, wall or ceiling coverings and the like.

PRIOR ART

In the field of laying of tiles for covering surfaces, such as flooring, walls and the like, it is known to use spacer devices which, in addition to spacing the tiles, allow the planar arrangement thereof, that is, they are such as to place the exposed surface of the tiles substantially coplanar; these devices are commonly called leveling spacers.

The known leveling spacer devices generally comprise a base, which can be positioned below the laying surface of at least two (three or four) adjacent tiles, from which at least one separator element rises, suitable to contact, through its lateral sides, the facing sides of the two (three or four) tiles to be placed next to each other on the laying surface, defining the width of the gap between the tiles.

The leveling spacer device, then, is provided with presser means cooperating with an emerging portion of the separator element which rises above the plane defined by the exposed surface of the tiles. The presser means are essentially provided with a planar surface facing the base which is adapted to press the exposed surfaces of all the products supported by the same base towards the base itself so as to level the exposed surfaces.

Among the known leveling spacer devices there are various types, one of these types provides that the presser is substantially a wedge which slides on the exposed surface of the products, a further typology of such leveling spacer devices is that of the so-called screw leveling spacer devices and provides that the presser essentially consists of a knob provided with a nut screw which is adapted to be screwed to a threaded stem (or the like) associated with the emerging portion of the separator element.

Once the presser has been screwed onto the threaded stem and has carried out its task of leveling the tiles, having waited for the adhesive on which the tile laying surfaces have been laid has hardened, it is sufficient to separate—for example thanks to pre-established breakage lines suitably made between the separator element and the base—the separator element from the base which will remain immersed in the concealed adhesive under the laying surface of the tiles.

The leveling spacer devices, in particular the screw-type spacers, have the drawback that the rubbing exerted by the presser on the exposed surface of the tiles, in the last tightening steps, can ruin the exposed surface of the tiles, scratching them. Furthermore, the rubbing between the tiles and the presser can be relieved in the form of centrifugal force on the tiles themselves, which are therefore unevenly enlarged at the device itself, widening or deforming the gap between the tiles, actually making the spacer function of the device itself ineffective.

To obviate these drawbacks it is known to use a ring that can be fitted to the threaded stem of the device installed (i.e. with the base already positioned below the tiles) and resting on the exposed surface of the tiles, which ring is suitable to be interposed between the laying surface of the tiles and the knob, so that in the final steps of tightening of the knob, the knob slides on the ring itself and this remains firmly fixed to the exposed surface of the tiles through a prismatic connection made between a suitably shaped through hole of the ring and the separator element.

This ring, however, involves a dead time of insertion on the installed spacer leveling devices and an additional charge for the personnel assigned to the laying of the sheet shaped products, which sometimes deliberately neglects the use thereof.

Moreover, this ring with shaped through hole with anti-rotation function occludes the sight of the gap at the device with the impossibility for the personnel in charge of the laying of the sheet shaped products to verify whether excess adhesive has emerged at the device due to the exercise of the pressure on the presser and, therefore, to remedy it before the hardening of the adhesive.

Again, if such a ring would not prevent the view of the gap at the device, or if it would not exhibit an anti-rotational through hole, but an enlarged through hole (for example circular), it would require the use of external appendages adapted to be gripped by a second hand of the person in charge of laying of the sheet shaped products, who while with the first hand tightens the presser, with such a second hand must hold the ring with respect to the knob.

One object of the present invention is to overcome the above drawbacks of the prior art with a simple, rational and cost-effective solution.

Such objects are achieved by the features of the invention disclosed in the independent claim. The dependent claims describe preferred and/or particularly advantageous aspects of the invention.

DISCLOSURE OF THE INVENTION

The invention, in particular, provides a leveling spacer device for laying sheet shaped products for the covering of surfaces which comprises:

- a base, which may be positioned at the rear of a laying surface of (i.e. facing below) at least two sheet shaped products being adjacent and placed side-by-side relative to a side-by-side direction;
- a separator element rising from, and perpendicular to, said base and suitable for sliding between the facing side walls of said two sheet shaped products placed side by side;
- a threaded stem rising from the separator element with a screw axis orthogonal to the base;
- a presser that can be screwed onto the threaded stem, and
- an anti-sliding protection ring suitable for being interposed between the presser and the base, wherein the protection ring comprises a first surface facing towards the presser and configured to come into contact therewith and a second opposing surface facing towards the base (and suitable for coming into contact with a visible surface of the sheet shaped products), wherein the second surface (or the interface between the second surface and the exposed surface of the sheet shaped products) has a sliding friction coefficient greater than a sliding friction coefficient of the first surface (or the interface between the first surface and the presser).

Thanks to this solution, the protection ring is configured so as not to stop its rotation—once its second surface comes into contact with the exposed surface of the tiles—without sliding on the exposed surface of the tiles, allowing—instead—the mutual sliding rotation between the presser and the first surface thereof. In practice, the protection ring due to the different configuration of the first surface with respect to the second surface prevents the presser from rubbing and ruining the exposed surface of the tiles.

According to an aspect of the invention, the first surface and the second surface have different configurations, for instance the first surface may have a different (greater) rigidity than the rigidity of the second surface, preferably the first surface may be rigid and the second surface may be substantially deformable and/or soft, for instance resiliently deformable (preferably in an axial direction).

For example, in this context rigidity means the resistance to deformation, in particular to deformation due to compression and/or shear stress and/or bending, preferably due to compression.

According to an aspect of the invention, the second surface may be made of an elastomeric material, for example rubber.

Thanks to this solution, the anti-sliding effect of the protection ring may be increased and made even more effective, allowing an efficient safeguard of the exposed surface of the tiles.

According to an aspect of the invention, the protection ring may be afforded in one piece obtained by molding of plastic materials (polymeric materials), more preferably, the protection ring may be afforded in one piece obtained by co-molding of plastic materials (polymeric materials), wherein the first surface may be made of a first plastic material, for instance a polymeric material (for example having a first rigidity), and the second surface may be made of a second plastic material, for instance polymeric and/or elastomeric, different from the first plastic material (for example having a second rigidity different to and/or smaller than the first rigidity).

Thanks to this solution, the protection ring according to the invention may be obtained in a simple manner without requiring assembly operations either for the manufacturer or for the end user.

In an alternative embodiment, the second surface (which may be made of the same material of the first surface or a different material, as described above) may be configured so as to exhibit a surface roughness greater than a surface roughness of the first surface intended to come into contact with the presser.

Thanks to this solution, the aforementioned anti-sliding effect can be obtained on the exposed surface of the tiles, especially if these are not particularly delicate.

According to an aspect of the invention, the protection ring may comprise a through hole suitable for being inserted with clearance onto the threaded stem and onto the separator element.

Preferably, the through hole may have a circular shape with a diameter greater than the maximum width of the separator element.

Thanks to this solution, the protection ring does not obstruct the insertion area between the tiles of the separator element and, therefore, allows the view thereof, thus allowing to verify and remove any rise of adhesive before the hardening of the latter.

According to a further aspect of the invention, the protection ring may be rotatably associated (in mutual sliding) relative to an axis of rotation coinciding with the screwing axis, at one end of the presser facing the base.

Preferably, between the protection ring and the presser there may be defined constraining means adapted to axially constrain the protection ring and the presser, for example the constraining means may comprise snap-on engaging members configured to axially constrain the protection ring and the presser in a removable manner while leaving free mutual rotation thereof relative to the axis of rotation.

Thanks to this solution, the protection ring may be previously anchored to the presser with an obvious advantage for the person in charge of laying the tiles, who can thus save time and ensure that the protection ring is always in the correct operating position.

BRIEF DESCRIPTION OF THE FIGURES

Further features and advantages of the invention will become apparent from the following description, provided by way of non-limiting example with the aid of the figures shown in the accompanying drawings.

BEST MODE OF CARRYING OUT THE INVENTION

Figure 1:
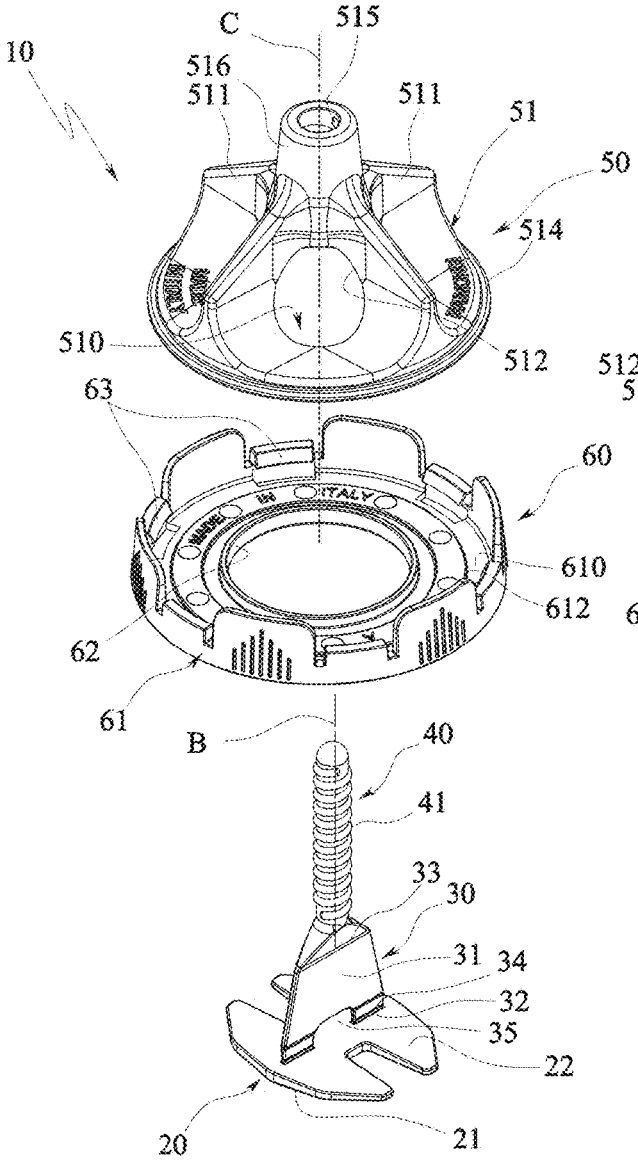
FIG. 1 is an axonometric exploded view of a leveling spacer device.
Figure 2:
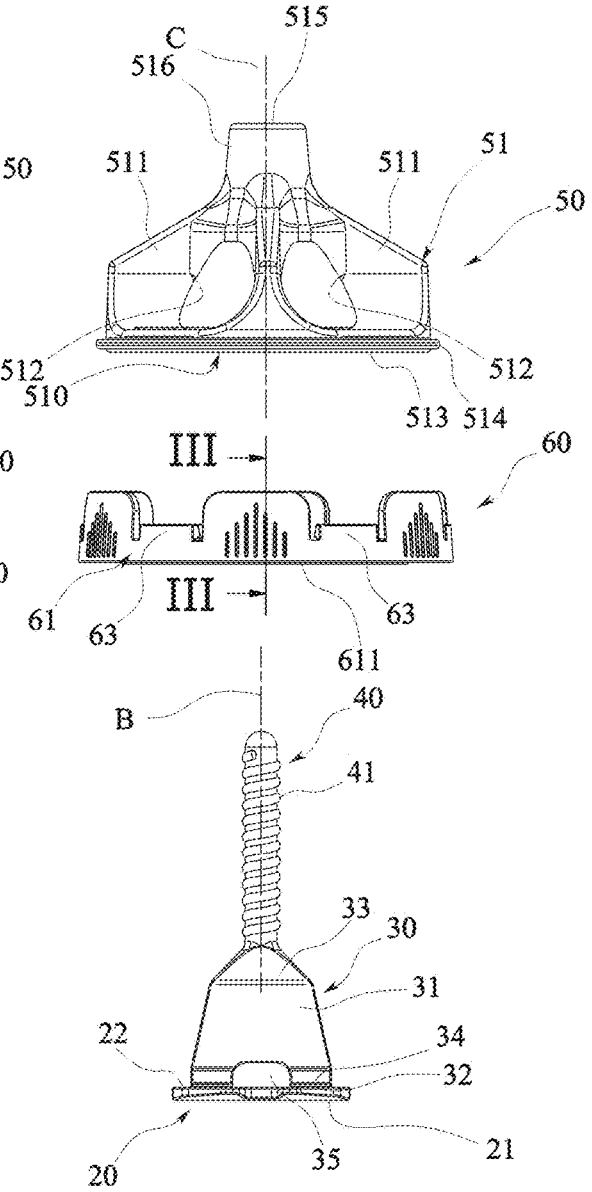
FIG. 2 is a front view of FIG. 1.
Figure 3:
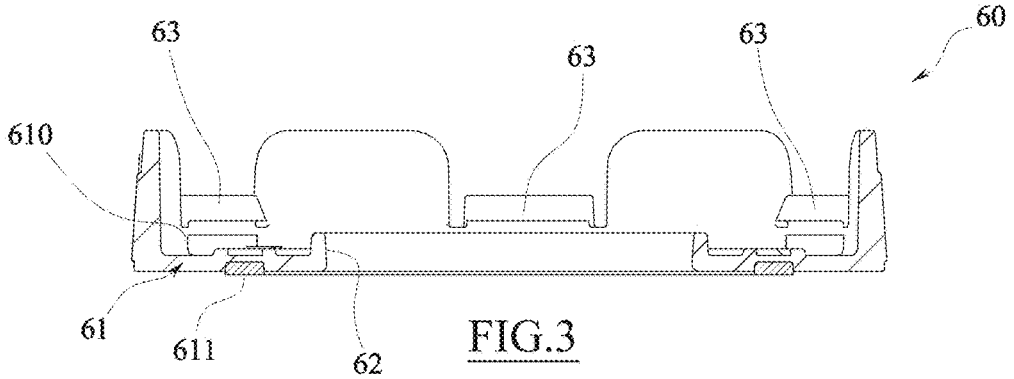
FIG. 3 is a sectional view along the line III-III in FIG. 2.
Figure 4:
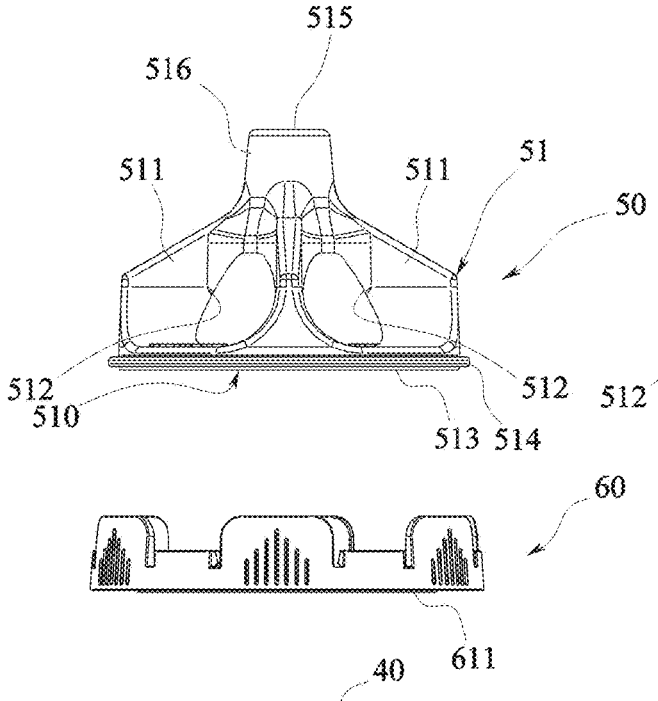
FIG. 4 is a lateral elevation view of FIG. 1.
Figure 4:
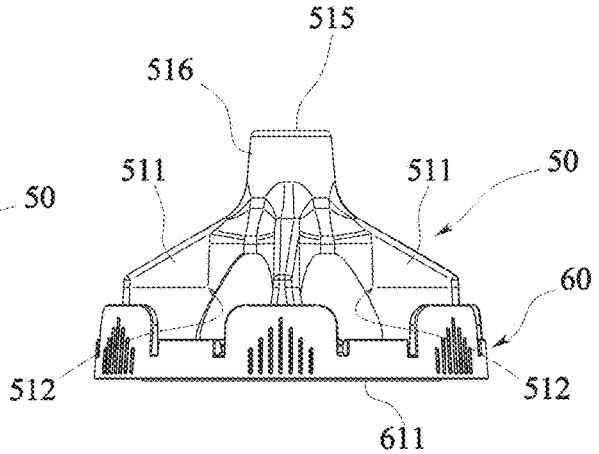
Figure 4:
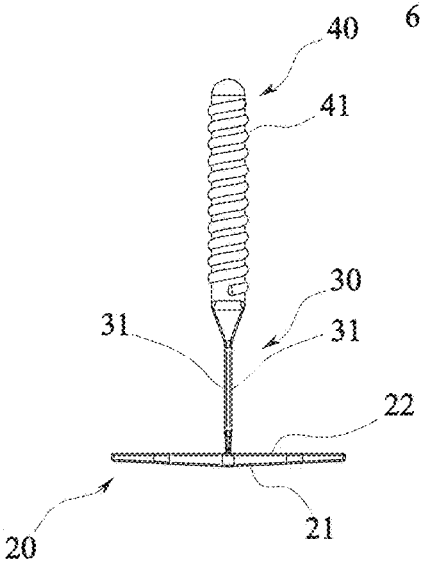
Figure 5:
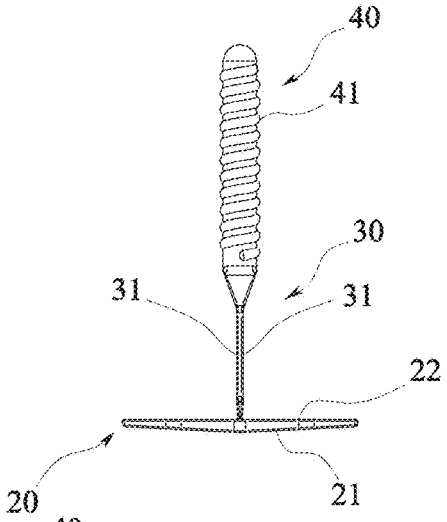
FIG. 5 is a view of the leveling spacer device in FIG. 1 with the protection ring constrained to the presser.
Figure 6:
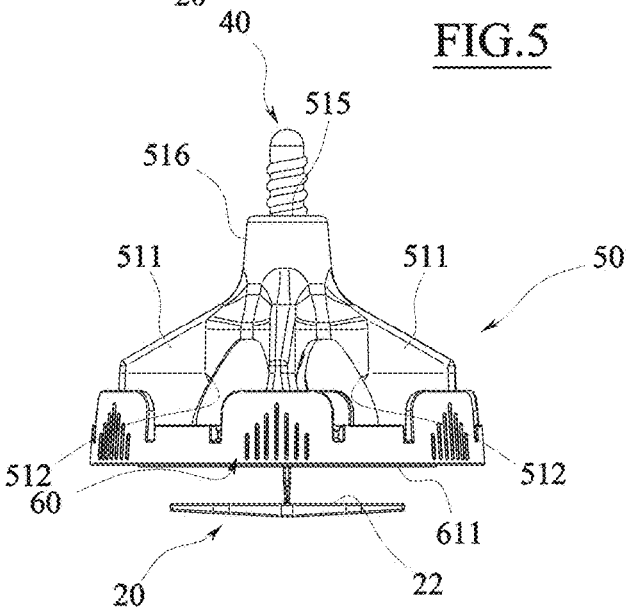
FIG. 6 is a view of the leveling spacer device in FIG. 6 with the presser screwed onto the threaded stem.
Figure 7:
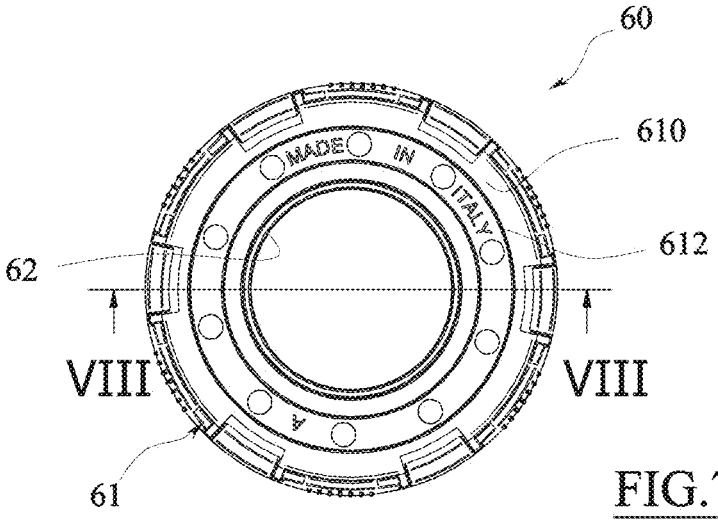
FIG. 7 is a top plan view of the protection ring of the leveling spacer device according to the invention.

With particular reference to these figures, reference numeral 10 generally designates a leveling spacer device to facilitate the laying of sheet shaped products, such as tiles and the like, generally indicated by the letter P, and suitable for covering surfaces, or flooring, walls, ceilings and the like.

Each tile P adapted to be laid to cover a surface has a wide laying surface P1, for example lower, and an opposite wide exposed surface P2, for example upper, preferably of homologous shape (for example polygonal, preferably quadrangular) with respect to the laying surface P1.

Each tile P then comprises a plurality of sides P3, generally perpendicular to the laying surface P1 and the exposed surface P2, which delimit the tile itself laterally.

The device 10 comprises a base 20 which is adapted for use to be placed behind the laying surface P1 of the tiles P (shown only schematically in FIGS. 16*a*-16*d*).

The base 20 in the illustrated example has an enlarged shape, for example polygonal, circular or irregularly shaped, defining a lower surface 21, for example flat or "V", adapted to be arranged distant from the laying surface P1 of the tiles P in and an opposing upper surface 22, for example flat, adapted to be arranged proximal to the laying surface P1 of the tiles P and, for example, in contact therewith. The upper surface 22 of the base 20 is in practice intended to receive in support a portion of the laying surface of one or more tiles P (side by side).

The base 20 is adapted to be immersed in a layer of adhesive arranged on a screed which is intended to be covered by the tiles P, with the lower surface 21 facing the screed itself and the upper surface 22 facing the overlying tiles P.

In certain laying situations, it is possible to provide that the base 20 may be placed resting on a flat fixing surface, such as a joist or the like, and fixed thereto.

In practice, the base 20 is positioned below at least two (or more) adjacent tiles as will appear better below.

The base 20 in the example shown is defined by a monolithic body, for example made of a plastic material (obtained by injection molding), which has a substantially polygonal shape (in plan).

The base 20, in the example shown, has an irregular shape (in plan), for example substantially octagonal, elongated along a longitudinal axis.

The base 20 has a symmetrical shape with respect to a central plane orthogonal to the base itself, for example with respect to a plane orthogonal to the longitudinal axis thereof.

In the example shown, the base 20 comprises, at the axial ends thereof, a pair of prongs extending parallel to the longitudinal axis of the same base defining therebetween a recess or central slot, for example passing through the thickness of the base.

In practice, such a recess or central slot defines an empty volume that can be filled, in use, by the adhesive, for retaining the laying surface P1 of the tiles P.

The base 20 may have, for example, a thickness at the central plane (of symmetry orthogonal to the longitudinal axis thereof) which is greater than a thickness thereof at the axial (opposing) ends and, for example decreasing from the central plane towards the axial ends.

In practice, such a thickness gradient of the base facilitates the person in charge of laying the tiles P to insert the base 20 below the laying surface P2 of the tiles P themselves when these are already resting on the layer of adhesive.

The device 10 also comprises a separator element 30 which rises perpendicular to the base 20, for example at the central (symmetry) axis, which is, in use, adapted to slide between facing sides P3 of at least two (or more) tiles P to be placed side by side along a side-by-side direction indicated in the figures with the letter A and contact the same defining the width of the interspace (or gap) between the tiles placed side by side.

In practice, the separator element 30 rises (vertically) from the upper surface 22 of the base perpendicular therewith.

The separator element 30 is a plate-like parallelepiped body, for example, with a rectangular base (very narrow and long, with a longitudinal axis orthogonal to the longitudinal axis of the base 20 or, however, lying on the central plane of the base itself) which defines a this (and wide) separation wall which divides the upper surface 22 of the base 20 into two opposing portions (equal and symmetrical with respect to the separator element itself in the example).

The separator element 30 therefore comprises at least two opposing planar and (mutually) parallel faces 31 whose mutual distance defines the thickness of the separator element 30 and, therefore, the width of the gap between the tiles P separated thereby.

Each face 31 is orthogonal to the upper surface 22 of the base 20.

In practice, each tile P which rests on one of the two portions of the upper surface 22 of the base 20 is adapted to contact one of the faces 31 of the separator element 30.

It is not excluded that the separator element 30 may also have an angular spacer arranged perpendicular to the faces 31 of the separator element itself.

For example, the angular spacer may be defined in a single piece with the separator element 30 (for example by interposing a facilitated breakage line, in order to be able to remove the angular spacer if necessary), which in this case may have a substantially cross or "T" section (for example again with a thin wall), so as to divide the upper surface 22 of the base 20, respectively, into four or three opposite portions, on which four or three tiles P can be positioned.

Moreover, the separator element 30 has a height (intended as the dimension along a direction orthogonal to the base 20) greater than the thickness of the tiles P to be laid, so that the top of the separator element 30, once the tiles are resting (with their own laying surface P1) on the upper surface 22 of the base 20, it protrudes above (abundantly) with respect to the plane to be leveled defined by the exposed surface P2 of the tiles P.

The separator element 30 has a lower end 32 preferably joined to the base 20 and an opposing free end 33 distal to the base 20.

The free end 33 may have, for example, upper walls sloping from the center towards the opposite longitudinal ends and, for example, an increased thickness with respect to the rest of the separator element 30.

Preferably, the separator element 30 is made in a single body (monolithic) with the base 20, or for example obtained by molding plastic material together with the base itself.

Furthermore, the separator element 30 has a predetermined breakage line or section 34 which is in use to be arranged below the level of the exposed surface of the tiles P to be spaced and leveled, for example at substantially the same level as the upper surface 22 of the base 20 or, as in the example, slightly higher.

For example, the predetermined breakage line or section 34 is formed on the separator element 30 in the proximity of the base 20, for example slightly above the level defined by the upper surface 22.

It is not excluded that the predetermined breakage line or section 34 may be formed at the junction line between the base 20 and the separator element 30.

In practice, the separator element 30, or the lower end 32 thereof, is joined to the base 20 by means of such a predetermined breakage line or section 34, which for example defines a breakage line substantially parallel to the upper surface 22 of the base 20 itself.

Thanks to such a predetermined breakage line or section 34 the entire emerging portion of the device 10, comprising the separator element 30, can be easily removed, once the tiles P are laid in place and the adhesive that supports them has hardened, while the portion immersed in the adhesive, i.e. the base 20 (and a small foot portion of the separator element 30), remains trapped (disposable) in the adhesive itself below the laying surface of the leveled tiles P.

The predetermined breakage line or section 34 extends longitudinally in a direction parallel to the upper surface 22 (and to the central plane) along the entire length of the separator element 30.

For example, the separator element 30 may have one or more through or blind lightening windows 35, for example in areas of the separator element located below the exposed surface P2 (minimum) of the tiles P to be laid with the device 10.

The device 10 then comprises a threaded stem 40, for example provided with a male thread 41, which rises perpendicularly to the base 20, preferably from the free end 33 of the separator element 30, axially extending the same.

In practice, the screwing axis, indicated with the letter B in the figures, is orthogonal to the upper surface 22 of the base 20.

The male thread 41 extends, for example, substantially over the entire length of the threaded stem 40 and, for example, has a constant pitch.

The threaded stem 40 in the example has a length substantially twice the height of the separator element 30.

Preferably, the threaded stem 40 is made in a single body (monolithic) with the separator element 30 (and the base 20), or for example obtained by molding plastic together with the base itself.

The device 10 then comprises a presser 50 which is adapted to be screwed onto the threaded stem 40.

The presser 50 comprises a knob 51 having a globally cup shape or inverted cup shape, or a concave shape (with concavity turned towards the base 20 in use).

The knob 51 extends, for example, around a central axis C, which is adapted to be arranged coaxial with the threaded stem 40 when the presser 50 is screwed thereon, as will be described more fully below.

In the example, the knob 51 has a substantially frusto-conical or dome shape, i.e. it has an enlarged (lower) end and a tapered opposite top.

It is not excluded that the knob 51 may have any other shape, such as cylindrical, butterfly-shaped, handle-shaped, or other suitable shape adapted to be gripped by a hand of a person in charge of laying it for the screwing thereof.

In the example, the enlarged (lower) end of the knob 51 defines an inlet mouth or cavity 510, for example substantially circular (coaxial with the central axis C of the knob itself).

The inlet cavity 510 has, for example, an inner diameter greater than the outer diameter of the male thread 41 of the threaded stem 40, so that the latter can be inserted axially with abundant radial clearance inside the inlet cavity 510 of the knob 51.

More preferably, the inlet cavity 510 has an inner diameter substantially equal to or greater than the width (maximum length) of the separator element 30, so that the latter can be inserted axially with radial clearance inside the inlet cavity 510 of the knob 51 itself, when the presser 50 is screwed onto the threaded stem 40.

In the illustrated example, the knob 51 comprises a substantially smooth inner skirt and a shaped outer skirt.

The outer skirt of the knob 51, for example, comprises reliefs 511 (or ridges), for example in number of 4, to facilitate the grip and the rotation drive for screwing the knob itself.

Each relief 511 has, for example, a substantially triangular shape, preferably with a side orthogonal to the inlet cavity 510 of the knob 51.

Moreover, the knob 51 may have one or more windows 512, for example through or transparent, made at the wall that joins the enlarged (lower) end of the knob 51 with the tapered top thereof.

For example, each window 512 is made at an interspace (or recess) between two adjacent reliefs 511.

Each window 512, in the example, goes without interruption from the outer skirt to the inner skirt and forms a descending and connecting ramp and, preferably, has a substantially ogive (rounded and elongated) shape, widened towards the enlarged (lower) end of the knob 51.

The knob 51, moreover, has a planar end 513 adapted to be turned towards the base 20 (parallel thereto) when the presser 50 is screwed onto the threaded stem 40 and perpendicular to the central axis C of the knob 51. The planar end 513 in fact peripherally (and at full extension) delimits the inlet cavity 510 of the knob 51.

The planar end 513 is for example substantially shaped like a circular crown, preferably defined by the base of a cylindrical shank coaxial to the central axis C and deriving inferiorly from the cap (truncated cone) portion of the knob 51.

In the example, the planar end 513 is defined by a pair of concentric circular crowns, each defined for example by the base of a cylindrical shank coaxial to the central axis C, as described above.

In practice, the planar end 513 is adapted to be directed in use towards the base 20 (or towards the tiles P resting on the base 20) and defines a perfectly planar annular surface perpendicular to the central axis C of the knob 51.

The knob 51 comprises, for example at or in the proximity of the planar end 513, an annular step 514 projecting radially towards the outside of the knob itself, for example of the outer skirt thereof and (also) of the reliefs 511.

The annular step 514, for example, has a substantially circular shape (at least the outer perimeter thereof) and is coaxial to the central axis C (and to the inlet cavity 510).

The annular step 514 therefore defines a concentric cylindrical (outer) surface with the central axis C of the knob 51.

Moreover, the annular step 514 defines a lower annular surface concentric to the central axis C of the knob 51, and for example orthogonal thereto, and an opposite upper annular surface, for example also planar and parallel to the planar end 513 (and placed at an upper level or closer to the top of the knob 51).

The presser 50 comprises, in particular, a nut screw 515 (female thread) configured to couple (with a helical coupling) with the male thread 41 of the threaded stem 40.

The female thread 515 has, for example, a screwing axis coinciding with the central axis C of the knob 51.

The female thread 515 is for example made at (or in proximity of) the tapered top of the knob 51

For example, the nut screw 515 is defined at an upper shank 516 which rises from the top of the knob 51, for example of a substantially frusto-conical (or cylindrical or prismatic) shape.

The nut screw 515 passes axially from side to side this upper shank 516 and, for example, at the inner end thereof (i.e. the one leading into the inner skirt of the knob 51) is provided with a groove-shaped taper to facilitate the axial insertion and alignment of the threaded stem 41 with the nut screw 515.

The nut screw 515 is advantageously defined by a continuous helix, preferably of a plurality of turns.

The presser 50 in the example shown is defined, as a whole, by a monolithic body, for example made of a plastic material (obtained by injection molding).

The device 10 further comprises a protection ring 60, which is adapted to be axially interposed—in operation—between the base 20 and the presser 50, or between the presser 50 and the exposed surface P2 of the P tiles resting on the base 20.

In detail, the presser 50 is rotatable (during its screwing rotation around the screwing axis B), in operation, with respect to the protection ring 60, which is kept stationary (as will be more apparent later) with respect to the exposed surface P2 of the tiles P.

The protection ring 60, in this case, comprises a sheet shaped body 61, for example of thin thickness, preferably of an annular shape (or any shape according to requirements) provided with an upper face (facing the presser 50, when in use) and an opposing lower face (facing the base 20, when in use).

The protection ring 60, or the sheet shaped body 61 thereof, comprises—at the upper face thereof—a first surface 610 (upper) intended to face the presser 50, when in use, and—at the lower face thereof—an opposing second surface 611 (lower), which is intended to face the base 20 (or facing the upper surface 22 of the base itself), when in use (i.e. when the protection ring 60 is interposed axially between the base 20 and the presser 50 themselves).

More particularly, the second surface 611 of the protection ring 60 is intended to face the surface P2 of the tiles P placed side by side and resting on the upper surface 22 of the base 20 and is configured to contact the exposed surface P2 of the tiles P themselves.

The first surface 610 and the second surface 611 are, for example, individually planar and substantially parallel to each other; preferably the first surface 610 and the second surface 611, in use, are substantially perpendicular to the screwing axis B of the female thread 515 on the threaded stem 40.

For example, the first surface 610 is substantially circular in shape.

The first surface 610 is adapted to contact (sliding, for example along a circular sliding path) with the planar surface 513 of the presser 50, during the screwing rotation of the presser 50 on the threaded stem 40.

In the example, the protection ring 60 has a first surface 610 for each planar surface 513 provided in the presser 50.

The first surface 610 (planar) could involve (occupy) the entire area of the upper (annular) face of the protection ring 60 or only a portion (annular or partially annular) thereof.

The protection ring 60 may have one or more centering ridges 612 placed at the upper face (surrounding the first surface 610, for example concentric therewith), for example with an annular shape or anyway adapted to define a track annular, engageable by the presser 50, for example to guide the mutual rotation thereof.

For example, the second surface 611 may be substantially annular, for example of a circular shape (or any shape).

Alternatively, the second surface 611 may be defined by a plurality of portions of discrete (distinct from each other) and coplanar planar surfaces and/or portions of discrete (distinct from each other) and coplanar precise surfaces that together form a planar surface.

The second surface 611 is adapted to contact (substantially by adhesion) the exposed surface P2 of the tiles P which rest on (the upper surface 22 of the) base 20 (and remain substantially braked/adhering thereto during the screwing rotation of the presser 50 on the threaded stem 40).

The second surface 611, in use, is adapted to contact the exposed surface P2 of the tiles P remaining substantially integral therewith (stationary, without friction) during the screwing rotation of the presser 50 on the threaded stem 40.

The second surface 611 (planar) could involve (occupy) the entire area of the lower (annular) face of the protection ring 60 or only a portion (annular or partially annular or in any case distributed) thereof.

In practice, the second surface 611 of the protection ring 60 is defined by the portion of the lower face of the protection ring 60 which is more distal from the upper face of the protection ring itself, on which the protection ring 60 rests when it is resting on the lower face itself.

In particular, the second surface 611 has a sliding friction coefficient (static or dynamic) greater than the sliding friction coefficient (respectively static or dynamic) of the first surface 610.

In other words, the protection ring 60 (or the first surface 610 and the second surface 611 thereof)—and, for example, the presser 50 (or the planar end 513 thereof)—is configured so that the second surface 611 in contact with the exposed surface P2 of the tiles P (whatever they may be) has a sliding friction coefficient greater than the sliding friction coefficient (respectively static or dynamic) of the first surface 610 in contact with the planar end 513 of the presser 50, for instance when they are subjected to the same imposed stress conditions (of mutual sliding and/or mutual sliding during the rotation about the central axis, namely the screwing axis B).

In other words, the second surface 611 and the first surface 610 when in contact with an identical (reference) surface, for example with the planar end 513, generate with such a (reference) surface a different sliding friction coefficient (i.e. a sliding-resistant force) and in particular, the second surface 611 in contact with this (reference) surface generates therewith a sliding friction coefficient (i.e. a sliding-resistant force) greater than the first surface 610 when in contact with the same (reference) surface, for instance when they are subjected to the same imposed stress conditions (of mutual sliding and/or mutual sliding during the rotation about the central axis, namely the screwing axis B).

In practice, the second surface 611 and the first surface 610 with the same conditions of contact with an identical surface (reference), which could be defined by the planar end 513), generate with it (when they are subjected to the same imposed stress conditions) a different sliding-resistant force, such that the sliding-resistant force exerted by the second surface 611 is greater than the sliding-resistant force exerted by the first surface 610.

That is, the second surface 611 is configured so as to exert a constraining sliding reaction (in opposition to a twisting moment which would cause it to rotate about an axis perpendicular to the second surface itself) on the exposed surface P2 of the tiles P (whatever they are) greater (in modulus) than a constraining sliding reaction (in opposition to a twisting moment which would cause it to rotate about an axis perpendicular to the second surface itself) which the first surface 610 exerts on the planar end 513 of the presser 50.

It is not excluded that the second surface 611 may be adhesive, for example by means of glue (of the attach-detach type) or by means of a suction or similar effect.

In a preferred embodiment, the first surface 610 is made of a material (plastic and/or polymeric) different from the material (plastic and/or polymeric and/or elastomeric) of which the second surface 611 is made.

Preferably, the first surface 610 is made of a first substantially rigid (nondeformable) material, for example it is made of plastic (or at the limit of metal).

Advantageously, the second surface 611 is made of a second resilient and/or adhesive and/or (axially) yielding and/or (axially) deformable material, for example it is made of an elastomeric material, such as for example rubber (preferably rigid rubber or plastic rubber) or silicone or another similar material.

In this case, the protection ring 60 may be advantageously obtained in a single body by co-molding of plastic materials.

For example, the protection ring 60 may be obtained from the (indissoluble and stable) union of a first supporting body (made of the first aforesaid material), which defines—among other things—also the first surface 610, and one or more second functional bodies (made of the aforesaid second material), which defines the second surface 611.

For example, the second surface 611 could be defined by the lower surface of one or more second functional bodies (having a defined thickness), of an annular shape or any shape, which have an upper surface (opposite to the lower surface) in direct stable adhesion contact with a superficial interface portion of the first support body of the protection ring 60 (at the lower face of the protection ring 60 itself).

Figure 8:
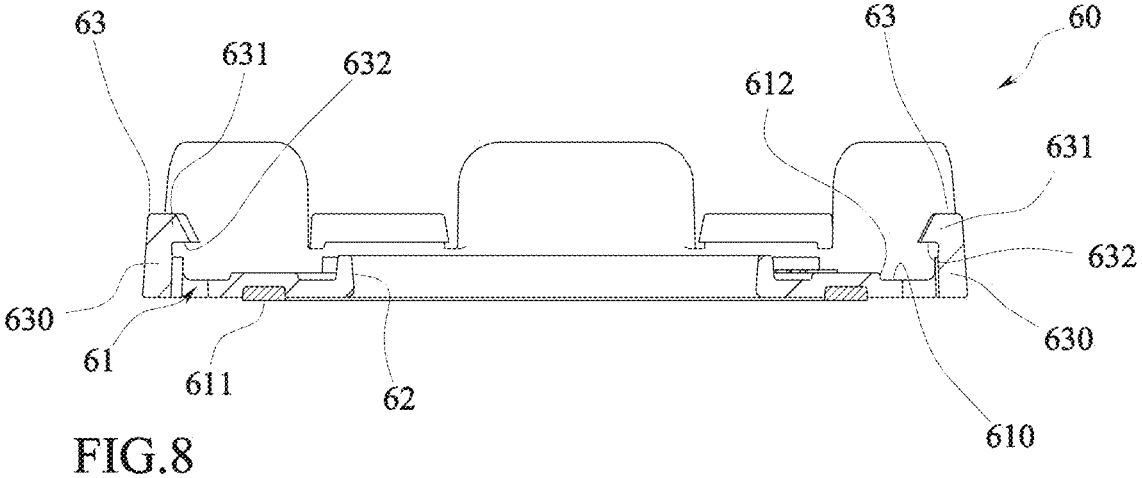
FIG. 8 is a sectional view along the section line VIII-VIII in FIG. 7.
Figure 9:
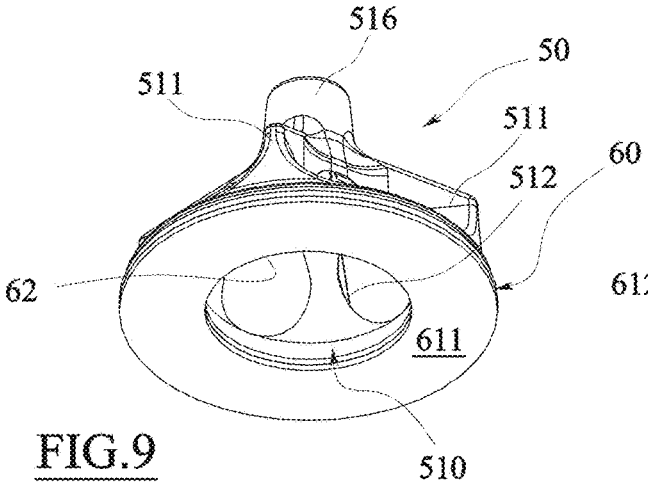
FIG. 9 is an axonometric bottom view of a protection ring according to an alternative embodiment constrained to the presser.
Figure 10:
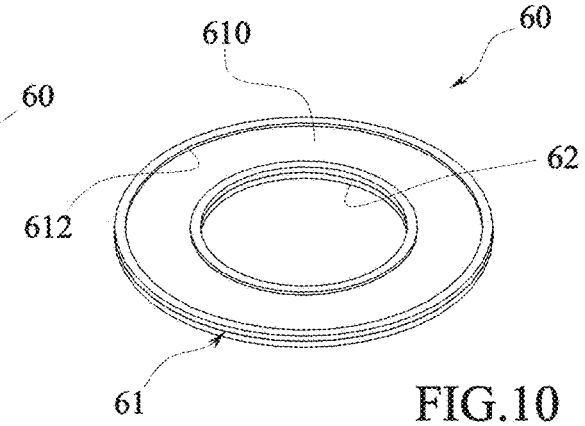
FIG. 10 is an axonometric top view of the protection ring in FIG. 9.
Figure 11:
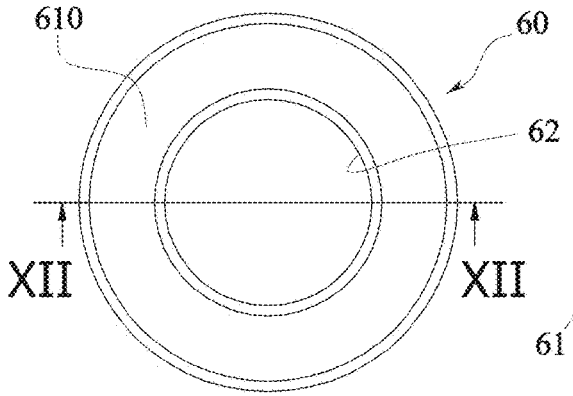
FIG. 11 is a top plan view of the protection ring in FIG. 9.
Figure 12:
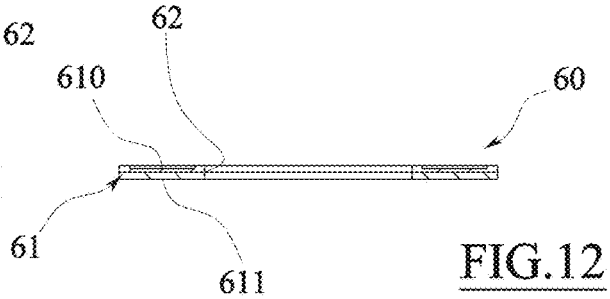
FIG. 12 is a sectional view along the sectional line XII-XII in FIG. 11.

For example, in the first support body of the protection ring 60, at the lower face thereof, a concave seat (with concavity facing downwards) may be defined, for example an annular seat, within which a root portion of the first functional body is received (and fixedly adhered), which emerges axially from the concave seat so as to make the second surface 611 defined thereby emerge (see FIG. 8).

It is not excluded that the second functional bodies are made of a plurality of feet, to examples having a semi-spherical or prismatic shape or any other shape which define, as a whole, a (single) bearing surface such as to constitute the second surface 611.

Furthermore, it is not excluded that—as shown in FIGS. 9-15—the second functional body of the protection ring 60 may be defined by an annular body having an outer diameter substantially equal to the outer diameter of the first support body and an inner diameter for example substantially equal to an inner diameter of the first support body itself, in which the first support body is also substantially annular in shape.

In an alternative embodiment, it is possible to provide that the second surface 611 can be removably associated with the protection ring 60.

For example, the protection ring 60 may be obtained from the (separable) union of a first supporting body (made of the first aforesaid material), which defines—among other things—also the first surface 610, and one or more second functional bodies (made of the aforesaid second material), which defines the second surface 611.

For example, the second surface 611 could be defined by the lower surface of one or more second bodies (having a defined thickness), of an annular shape or whatever, which have an upper surface (opposite to the lower surface) fixed to (for example in direct contact with) a superficial interface portion of the first support body of the protection ring 60 (at the lower face of the protection ring 60 itself).

For example, in the first support body of the protection ring 60, at the lower face thereof, a concave seat (with concavity facing downwards) may be defined, for example an annular seat, within which a root portion of the first functional body is received—such as by interference or snap—which emerges axially from the concave seat so as to make the second surface 611 defined thereby emerge.

For example, the second functional body may be made by a resilient ring of the "O-ring" type.

It is not excluded that—even in this embodiment—the second functional bodies may be made of a plurality of snap-coupled feet or in any case fixed in a removable manner, for example hemispherical or prismatic in shape or any other shape which define, as a whole, a (single) bearing surface such as to constitute the second surface 611.

Furthermore, as an alternative to what has been described above, it is possible to provide that the first surface 610 may be made of a plastic material which is the same as (or even different from) the plastic material of which the second surface 611 is made.

In this case, the difference between the sliding friction coefficient between the first surface 610 and the second surface 611 may be achieved by means of a different configuration of the surface roughness between the first surface 610 and the second surface 611 themselves.

In particular, the protection ring 60—which could be obtained in a single monolithic body by molding a (single) plastic material—may be configured so that the second surface 611 has a surface roughness greater than the surface roughness of the first surface 610 intended to come into contact with the presser 50.

The protection ring 60 then comprises a through hole 62 (through in axial direction), for example central (or coaxial with the first surface 610), which passes through the sheet shaped body 61 from side to side and is open at the upper face and the opposite lower face of the protection ring 60.

In a preferred embodiment shown in FIGS. 1-12, the through hole 62 has a circular shape with an inner diameter greater than the maximum length of the separator element 30, which can then slide (with its threaded stem 40) axially (with radial clearance) in the through hole 62 of the protection ring 60.

In an alternative embodiment, the through hole 62 may have any shape with a minimum diameter that is in any case greater than the maximum length of the separator element 30.

Figure 13:
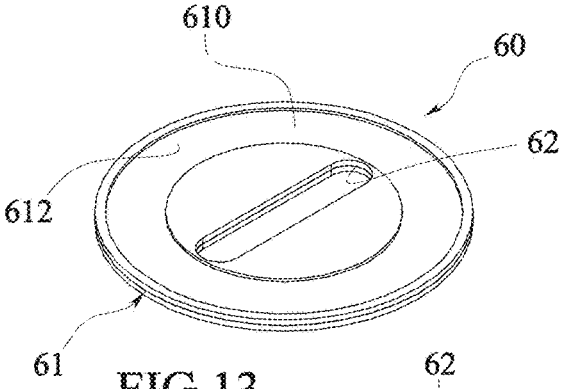
FIG. 13 is an axonometric top view of a further alternative embodiment of a protection ring according to the invention.
Figure 14:
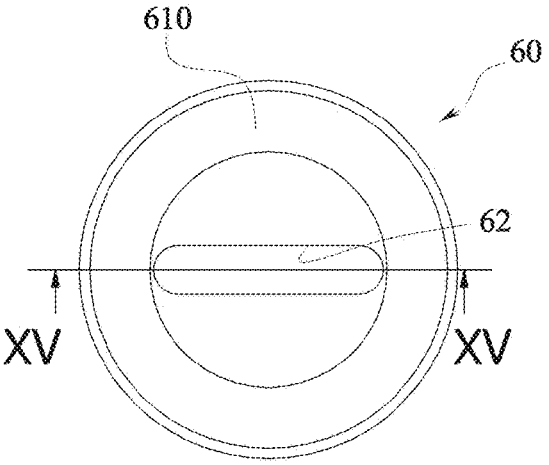
FIG. 14 is a top plan view of the protection ring in FIG. 13.
Figure 15:
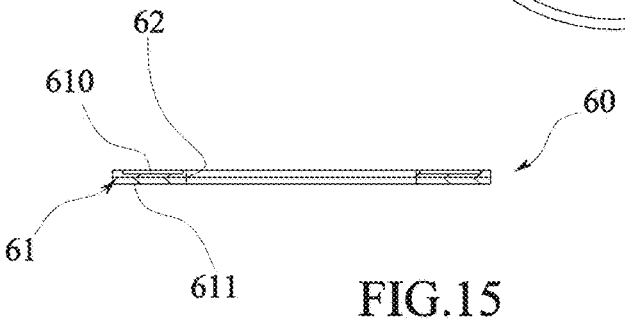
FIG. 15 is a sectional view along the section line XV-XV in FIG. 14.
Figure 16A:
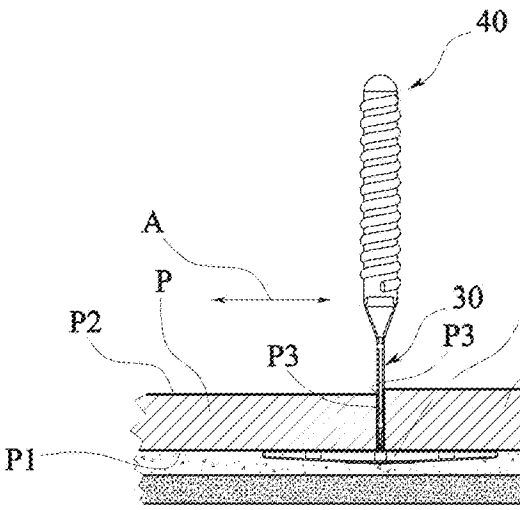
FIGS. 16*a*-16*d* show a sequence of operation of the leveling spacer device according to the invention.
Figure 16B:
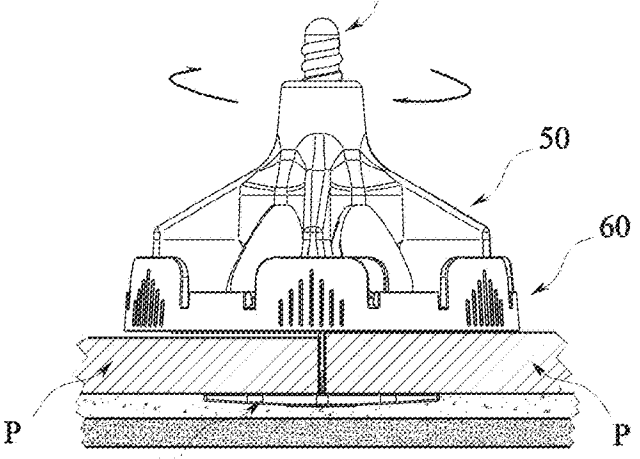
Figure 16C:
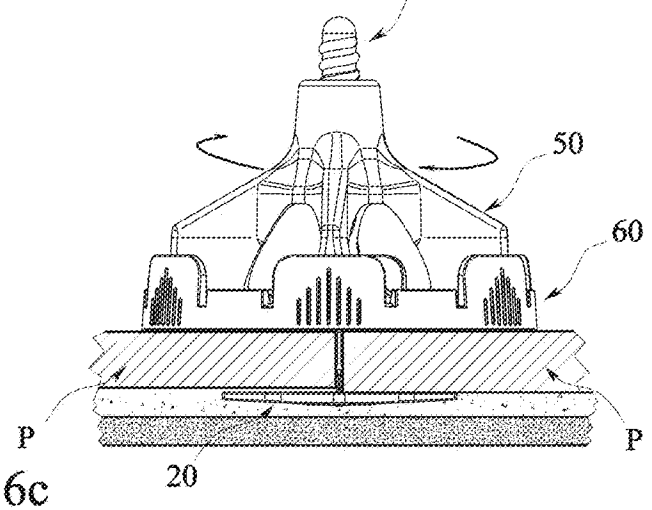
Figure 16D:
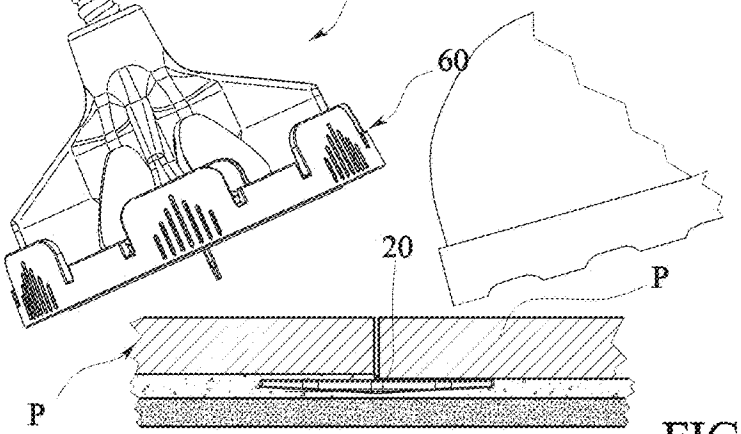
Figure 17A:
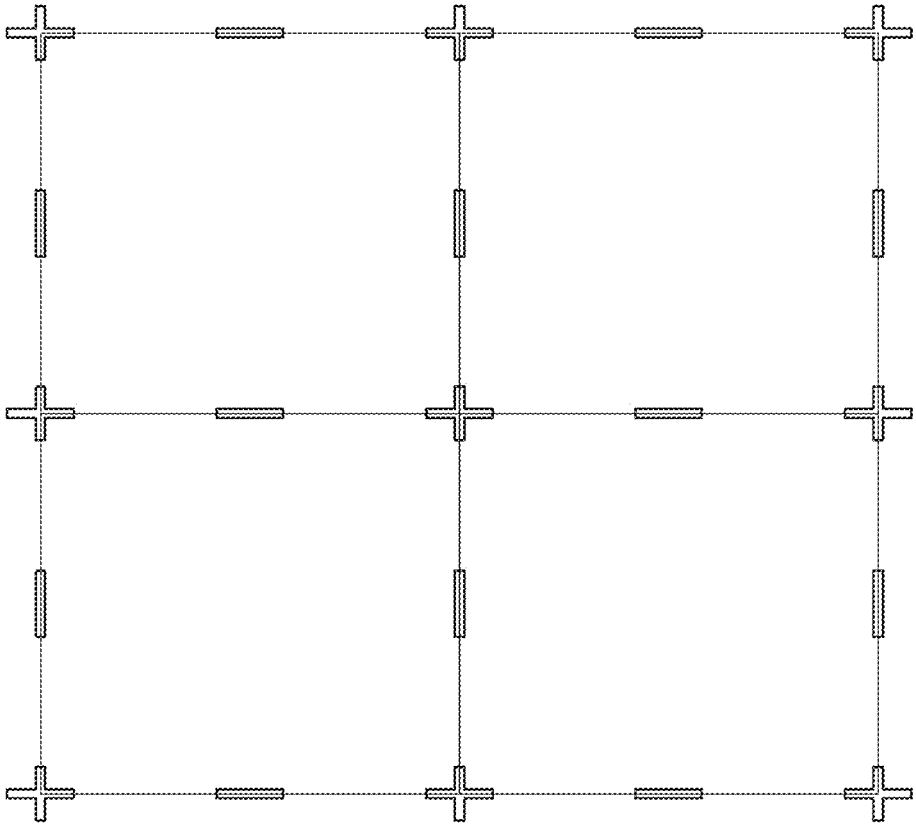
FIG. 17*a* is a schematic plan view of a first possible laying scheme of sheet shaped products, so-called "a sorella" (with contiguous joints).
Figure 17B:
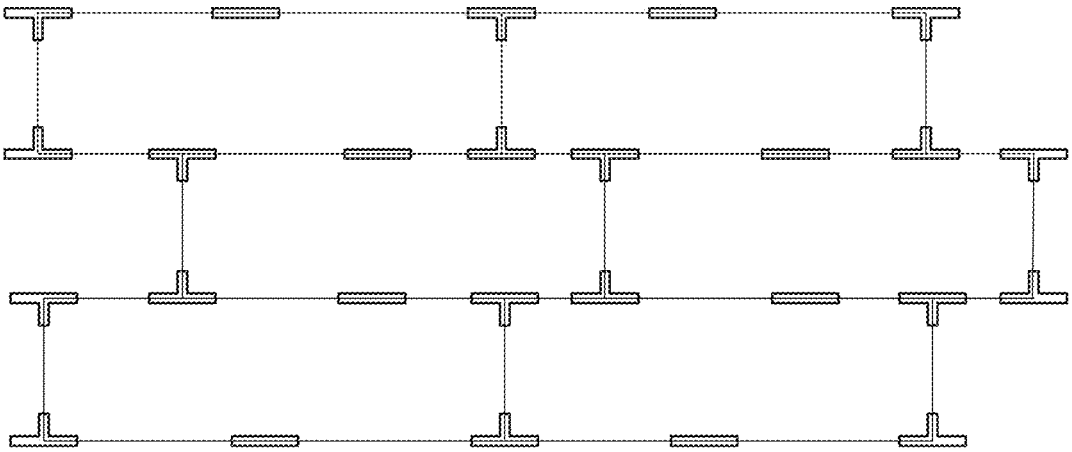
FIG. 17*b* is a schematic plan view of a second possible laying scheme of sheet shaped products, so-called "staggered".
Figure 17C:
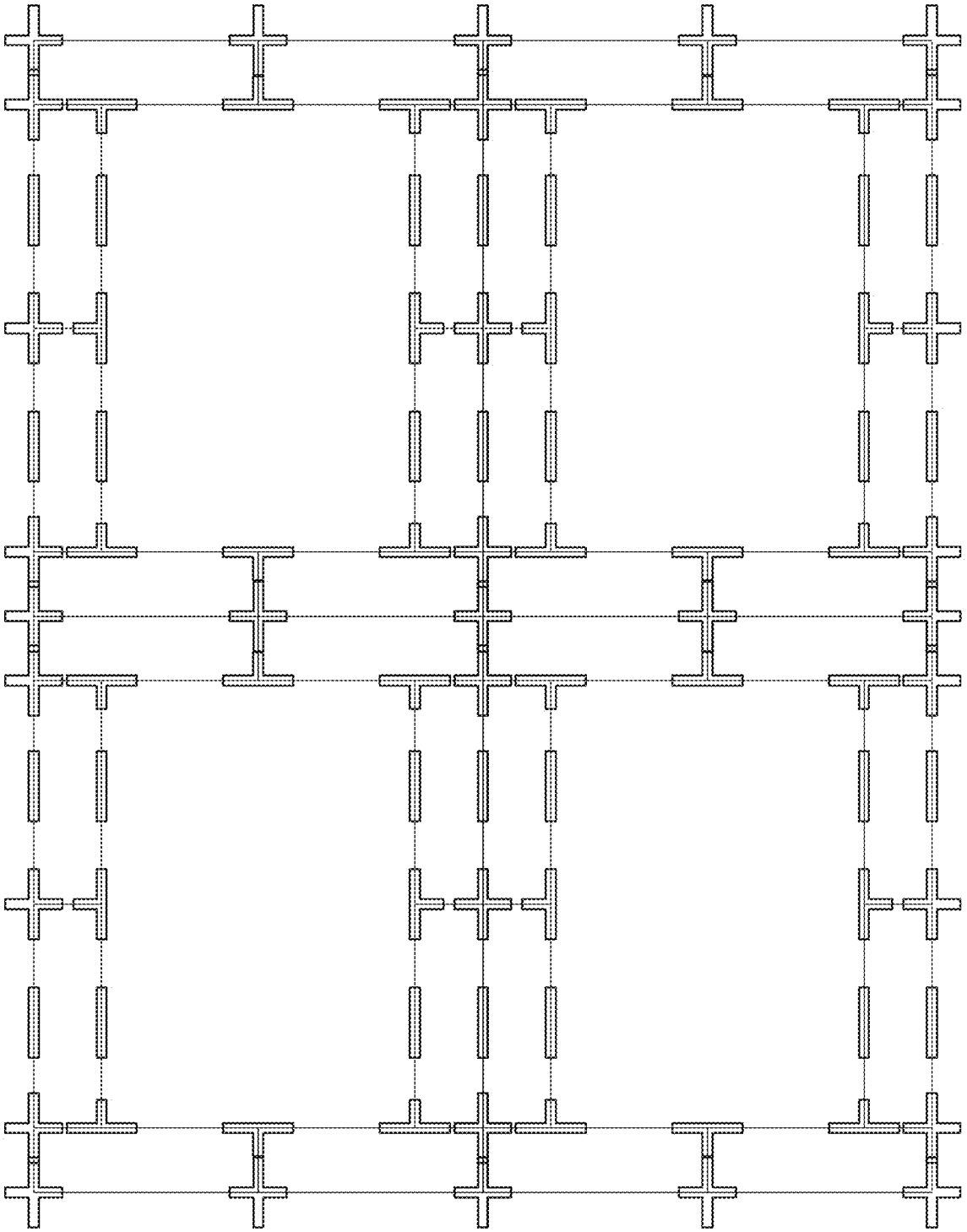
FIG. 17*c* is a schematic plan view of a third possible laying scheme of sheet shaped products, so-called "complex".

Moreover, alternatively (as shown in FIGS. 13-15), the through hole 62 has an elongated shape like a slit with a radial longitudinal axis with respect to the central axis of the protection ring 60 and preferably passes through the center of the protection ring 60. In practice, this through hole 62 shaped like a slit is centered on the axis of the protection ring 60.

In the example, this through hole 62 shaped as a slit is narrow and long, with a length slightly greater than the length of the separator element 30 and with a width slightly greater (for example less than 2 times) the thickness of the separator element 30.

The through hole 62 shaped like a slit is therefore configured to fit (with clearance) onto the separator element 30 (and to determine a prismatic connection therewith).

In practice, the separator element 30 can be inserted axially inside the through hole 62 shaped as a slit and, once the separator element 30 is engaged inside such a through hole 62 shaped as a slit, the mutual rotation is prevented (except for small oscillations due to the tolerances involved and to the necessary clearance which allows the comfortable insertion of the separator element 30 in the slit 61) between the protection ring 60 and the separator element itself.

In this case, the through hole 62 shaped as a slit, for example, has substantially straight and parallel lateral ides between which the separator element 30 is substantially accommodated (with reduced lateral clearance).

Such a through hole 62 shaped as a slit exhibits a dimension such that even the threaded stem 40 can be inserted (with abundant clearance) axially therein.

Preferably, the protection ring 60 is rotatably associated with the presser 50, for example relative to an axis of rotation E coinciding with the screwing axis of the female thread 51 of the presser itself.

The protection ring 60 is adapted to be associated with the planar end 513 of the presser 50, or at the end thereof facing the base 20, so as to interpose itself between the base 20 and such a planar end 513 (and, in use, between the exposed surface of the tiles P and the planar end 503 itself) when the presser 50 is screwed onto the threaded stem 40.

Preferably, as shown in FIGS. 1-8 and 16*a-d*, between the protection ring 60 and the presser 50 there are defined constraining means adapted to axially constrain the protection ring 60 and the presser 50, allowing the (free) reciprocal rotation relative to the axis of rotation E (coinciding with the screwing axis when the protection ring 60 is constrained to the presser 50).

The constraining means are for example a snap coupling configured to axially constrain, in a removable or semi-permanent manner, the protection ring 60 and the presser 50 and leaving, as said, the mutual rotation therebetween free relative to the axis of mutual rotation.

In this case, the protection ring 60 comprises a plurality of coupling teeth 63 protruding, for example in an axial direction on the opposite side with respect to the second surface 611 and aligned along an imaginary circumference coaxial with respect to the protection ring 60 itself and, for example, having a diameter substantially greater than the outer diameter of the annular step 514 of the presser 50.

Each coupling tooth 63 has a leg 630 rising from the protection ring 60 (or from the upper face thereof), one end of which is derived, for example in a single body therewith, from a peripheral portion of the protection ring itself and whose opposing free end comprises a hooking head 631 substantially shaped like a pawl facing the axis of rotation E of the protection ring 60 and defining a hooking surface 6322, substantially planar, facing the upper face (i.e. the first surface 611) of the protection ring itself.

The coupling surface 632 is away from the upper face (or the first surface 611) of the protection ring 60 by a height substantially equal to or slightly greater than the height of the annular step 514.

The coupling tooth 63, for example the leg 630 thereof, is elastically yielding, preferably in a radial direction, so that it can be snapped onto the presser 50, or to the annular step 514 thereof.

The coupling tooth 63, for example the leg 630 thereof, has in the direction of its circumferential width thereof an arched conformation (of a circular sector) with concavity turned towards the central axis of the protection ring 60.

The coupling head 631 further defines a surface opposite to the coupling surface 632 which can be inclined with respect to the first surface 610 by an acute grooved angle, such as to impart a radial thrust (towards the outside of the protection ring 60) to the hooking tooth 63 following an axial compression thrust on the coupling head 631 of the coupling tooth itself.

In practice, the snap coupling between the presser 50 and the protection ring 60 is defined by the coupling between the coupling teeth 63 and the annular step 514. The coupling teeth 63 by radially spread, following a mutual axial movement of approach between the presser 50 and the protection ring 60, allow the annular step 514 to enter between the coupling teeth themselves, in practice bringing the end planar 513 of the presser 50 in contact (of circumferential sliding) with the first surface of the protection ring 60, and possibly the hooking surface 632 of the coupling teeth 63 in contact (of circumferential sliding) with the opposing upper annular surface of the annular step 514.

The legs 630 of the hooking teeth 63, as a whole, can define a cylindrical surface (partially) coaxial with the protection ring 60 and within which the peripheral edge of the annular step 514 rotates.

It is not excluded that the constraining means which mutually constrain the protection ring 60 and the presser 50 in an axial direction, leaving the reciprocal rotation free, may be different from those illustrated, for example of the interference type or other suitable connection, either semi-permanent or removable or at the limit permanent, depending on the construction requirements.

Furthermore, it is possible to provide—in a more simplified embodiment—that these constraining means are not present, as shown for example in the embodiments shown in FIGS. 9-15. In this case, the protection ring 60 may be interposed from time to time between the presser 50 and the exposed surface P2 of the tiles P, for example resting with the second surface 611 thereof on the exposed surfaces P2 of the tiles P themselves. Even in this case, however, it is possible to provide that the protection ring 60 has centering ridges 612 placed in correspondence with the upper face (surrounding the first surface 610, for example in a concentric manner to it), for example of an annular shape. or in any case adapted to define an annular track, which can be engaged by the pressure element 50, for example to guide its reciprocal rotation, once the first surface 610 is brought into contact with the planar end 513 of the presser 50.

In light of the foregoing, the operation of device 10 is as follows.

In order to cover a surface with a plurality of tiles P it is sufficient to lay a layer of adhesive thereon and, subsequently, it is possible to lay the tiles P thereon.

In practice, where the first tile P must be laid, it is sufficient to position a first device 10, the base 20 of which is intended, for example, to be placed under two edges of respective tiles P, an edge and two corners of three respective tiles P or four edges of respective four tiles P, depending on the desired laying pattern.

Once the base 20 has been positioned, it is sufficient to position the tiles P so that a portion of the side P3 is in contact respectively with one of the faces 31 of the separator element 30.

This ensures the perpendicular arrangement and the equidistance between the tiles P that surround the device 10. When, for example, the tiles P have particularly large dimensions, then it is possible to position a device 10 even at a middle area of the side P3 of the tile itself.

It is not excluded that, for example, one operates by laying first a tile P and subsequently at the edge or a side P3 thereof, a base portion 20 of the device 10 is inserted below it.

Once the various bases 20 have been positioned with the respective separator elements 30 (and possible angular spacers) as described above, as long as the adhesive is still not completely hardened, a presser 50 is fitted and screwed into a respective threaded stem 40, so that the presser gradually descending towards the exposed surface P2 of the tiles resting on the base 20 presses on them, locally at the various points (middle or corner), allows the perfect leveling of the exposed surfaces P2 of the tiles themselves affected by the same device 10

In practice, for example after having joined together, by means of the constraining means, the protection ring 60 and the presser 50, it is sufficient to axially insert the free end of the threaded stem 40 of the through hole 62 and, from it, within the inlet cavity 510 of the presser 50 until the male thread 41 enters the female thread 51.

Subsequently, in order to quickly bring the second surface 611 of the protection ring 60 close to the visible surface of the tiles P it is sufficient to impart a twisting moment (right-handed) on the upper shank 516 (by two fingers) so that the nut screw 51 engages the thread male 41 of the threaded stem 40 and, preferably spontaneously, the presser 50 is screwed quickly onto the threaded stem 40.

The axial (spontaneous) stroke of the presser 50 is interrupted when the second surface 611 of the protection ring 60 reaches the exposed surface P2 of one or more of the tiles P superimposed over it axially.

At this point, the person in charge of laying, by rotating the presser 50, for example by gripping the reliefs 511 with his fingers, screws the latter onto the threaded stem 40 so as to exert a gradual pressure, suitably calibrated and controllable, on the exposed surface P2 of all the tiles P on which the second surface 611 of the protection ring 60 rests.

During such a screwing/tightening rotation, the protection ring 60 remains stationary (integral with the tiles P and/or the threaded stem 40 and the separator element 30) although it can slide axially.

In practice, the second surface 611 defines an adherent support surface (anti-sliding) on the exposed surface P2 of the tiles P on which it rests which prevents the protection ring 60 from being able to rotate although subjected to a twisting moment due to the sliding contact between the planar end 513 of the presser 50 and the first surface 610 of the protection ring 60.

In practice, the difference in the friction coefficient between the first surface 610 and the second surface 611 of the protection ring 60 is such as to allow the reciprocal rotation (with respect to the screwing axis B) of the presser 50 and the protection ring 60, albeit in mutual sliding contact by means of the first surface 611, but at the same time preventing the reciprocal rotation (with respect to the screwing axis B) between the protection ring 60 and the exposed surface P2 of the tiles P resting on the base 20 and in contact with the second surface 611 of the protection ring 60.

The planar end 513 of the pressure element 50, on the other hand, slides during the screwing rotation which allows the clamping of the presser 50 and—therefore—the leveling of the tiles P, on the first surface 610 of the protection ring 60, in fact not interfering with the exposed surface P2 of the tiles P themselves.

Finally, when the adhesive has hardened and is gripped on the laying surface of the tiles P, one proceeds with the breaking, for example with a kick, the separator element 30 along the predetermined breakage line or section 34, thus removing the same separator element 30, with the presser 50 screwed to the threaded stem 40, to be able to proceed to fill the joints between the tiles P without the base 20 being visible on the finished surface.

In order to be able to re-use the presser 50, with the relative protection rings 60, it is sufficient to remove the threaded stem 40 from the engagement with the female thread 51 for example by imparting a twisting moment (left-handed) on the upper shank 516 (by means of two fingers) in a manner that the nut screw 51 is unscrewed from the male thread 41 of the threaded stem 40 quickly (and spontaneously).

The invention thus conceived is susceptible to numerous modifications and variations, all of which are within the scope of the inventive concept.

Moreover, all details can be replaced with other technically equivalent elements.

In practice, the materials used as well as the shapes and sizes may be any according to the requirements, without departing from the protection scope of the following claims.

The invention claimed is:

1. A levelling spacer device for laying sheet shaped products having a laying surface for covering surfaces, the device comprising:

a base configured to be positioned under the laying surfaces of at least two of the sheet shaped products being placed adjacent and side-by-side to one another relative to a side-by-side direction;

a separator element rising from, and perpendicular to, said base, and configured to slide between facing side walls of said at least two of the sheet shaped products placed adjacent and side-by-side to one another;

a threaded stem rising from the separator element with a screw axis orthogonal to the base;

a presser configured to be screwed onto the threaded stem; and an anti-sliding protection ring configured to be interposed between the presser and the base, wherein the anti-sliding protection ring comprises a first surface facing towards the presser and configured to come into contact with the presser and an opposing second surface facing towards the base and configured to come into contact with the surface of the sheet shaped products opposite the laying surface thereof when in use, and wherein the second surface has a sliding friction coefficient greater than a sliding friction coefficient of the first surface to provide protection against sliding of the anti-sliding protection ring when the presser is being screwed onto the threaded stem.

2. The device according to claim 1, wherein the second surface comprises an elastomeric material.

3. The device according to claim 2, wherein the elastomeric material is rubber.

4. The device according to claim 1, wherein the protection ring comprises a one piece molded plastic material.

5. The device according to claim 1, wherein the protection ring comprises a one piece molded plastic comprising two or more materials, wherein the first surface is made of a first plastic material and the second surface is made of a second plastic material different from the first plastic material.

6. The device according to claim 1, wherein the second surface exhibits a surface roughness greater than a surface roughness of the first surface intended to come into contact with the presser.

7. The device according to claim 1, wherein the protection ring comprises a through hole configured to be inserted with clearance onto the threaded stem and onto the separator element.

8. The device according to claim 7, wherein the through hole has a circular shape with a diameter greater than a maximum width of the separator element.

9. The device according to claim 1, wherein the protection ring is rotatably associated with the presser relative to an axis of rotation coinciding with the screw axis, at one end of the presser facing the base.

10. The device according to claim 9, further comprising a coupling defined between the protection ring and the presser configured to axially constrain the protection ring and the presser.

11. The device according to claim 10, wherein the coupling comprises snap-on engaging members configured to axially and removably constrain the protection ring and the presser while leaving free mutual rotation thereof relative to the axis of rotation.

12. The device according to claim 1, wherein the first surface has a rigidity greater than a rigidity of the second surface.

13. The device according to claim 1, wherein the first surface comprises a material different than a material of which the second surface is comprised.

14. The device according to claim 1, wherein the second surface is removably associated with the protection ring.

15. The device according to claim 1, wherein, when the second surface and the first surface are in contact with an identical reference surface, the second surface and the first surface generate, with said identical reference surface, different sliding friction coefficients, wherein the second surface in contact with the reference surface generates therewith a first sliding friction coefficient greater than a second sliding friction coefficient generated by the first surface when in contact with the identical reference surface.

* * * * *